US009861145B2

(12) United States Patent
McIntire, Jr.

(10) Patent No.: US 9,861,145 B2
(45) Date of Patent: Jan. 9, 2018

(54) CONCEALABLE BODY ARMOR AND COMBINATION BAG/VEST

(71) Applicant: MARTINSON INDUSTRIES, LLC, Portland, ME (US)

(72) Inventor: Allan Ray McIntire, Jr., South Portland, ME (US)

(73) Assignee: Martinson Industries, LLC, Portland, ME (US)

( * ) Notice: Subject to any disclaimer, the term of this patent is extended or adjusted under 35 U.S.C. 154(b) by 0 days.

(21) Appl. No.: 15/675,789

(22) Filed: Aug. 14, 2017

(65) Prior Publication Data

US 2017/0340033 A1 Nov. 30, 2017

Related U.S. Application Data

(63) Continuation of application No. 14/153,687, filed on Jan. 13, 2014, now Pat. No. 9,737,100.

(51) Int. Cl.

| | |
|---|---|
| ***A01B 1/06*** | (2006.01) |
| ***A41D 15/04*** | (2006.01) |
| ***F41H 1/02*** | (2006.01) |
| ***A41D 13/05*** | (2006.01) |

(52) U.S. Cl.
CPC ..... *A41D 15/04* (2013.01); *A41D 13/0518* (2013.01); *F41H 1/02* (2013.01)

(58) Field of Classification Search
CPC ..... A41D 15/04; A41D 13/0518; F41H 1/02
See application file for complete search history.

(56) References Cited

U.S. PATENT DOCUMENTS

| | | | | | |
|---|---|---|---|---|---|
| 3,452,362 | A * | 7/1969 | Korolick | F41H 1/02 | 2/2.5 |
| 4,697,285 | A * | 10/1987 | Sylvester | F41H 1/02 | 2/2.5 |
| 4,830,245 | A * | 5/1989 | Arakaki | A45F 3/04 | 2/2.5 |
| 5,031,733 | A * | 7/1991 | Chang | A41D 15/04 | 190/1 |
| 5,327,811 | A * | 7/1994 | Price | F41H 1/02 | 2/2.5 |
| 5,431,318 | A * | 7/1995 | Garcia | F41C 33/00 | 2/2.5 |
| 5,829,653 | A * | 11/1998 | Kaiser | A45F 4/02 | 2/2.5 |
| 6,419,132 | B1 * | 7/2002 | Reed | A45C 15/00 | 109/49.5 |
| 6,685,071 | B2 * | 2/2004 | Prather | A45C 15/00 | 2/2.5 |
| 7,441,278 | B2 * | 10/2008 | Blakeley | F41C 33/06 | 2/102 |
| 8,387,166 | B2 * | 3/2013 | Eastep | A41D 15/04 | 2/102 |

* cited by examiner

*Primary Examiner* — Richale Quinn
(74) *Attorney, Agent, or Firm* — Tredecim LLC; Sean L. Sweeney

(57) ABSTRACT

Described herein are combination bag/vests which, in a bag configuration, serve as a functional bag and which, in a vest configuration, include a system for attaching one or more modular accessories to the vest in a desired configuration. Also described herein are such combination bag/vests wherein the vest configuration operates as a tactical personal body armor vest and the bag configuration conceals the tactical vest portion while permitting the one or more modular accessories to remain in the desired configuration.

12 Claims, 13 Drawing Sheets

CONCEALABLE BODY ARMOR AND COMBINATION BAG/VEST

CROSS-REFERENCE TO RELATED APPLICATIONS

This application is a continuation application claiming the benefit of U.S. patent application Ser. No. 14/153,687, filed Jan. 13, 2014, the disclosure of which is herein incorporated by reference.

BACKGROUND

1. Field of the Invention

The present invention relates generally to multifunction garments and personal body armor and more particularly to a combination bag/vest and concealable personal body armor.

2. Discussion of Background Information

Police officers and military personnel generally wear tactical personal body armor vests such as bullet resistant vests into a situation with the potential for violence such as gun fire. Such tactical vests are generally tailored to provide maximal protection and maneuverability for the wearer. These vests also generally have systems for attaching, in any configuration desired by the wearer, tactical gear such as, for example, pouches for ammunition or first aid gear and holsters for radios, stun guns, knives, tear gas, or sidearms.

Unfortunately, these personnel are often placed in mission scenarios where overtly wearing a bullet resistant vest and/or carrying weapons, ammunition, or other tactical gear is impossible. For example, an undercover police officer investigating a criminal organization may have arranged for a raid on a gathering of his subjects. However, as an attendee of the gathering, that officer would not be able to wear personal body armor such as a tactical bullet resistant vest without raising suspicion. Without armor and/or other tactical gear, this officer's life will be at increased risk in the likely event of violence. Unfortunately, other than carrying such tactical gear in a bag or overtly wearing it, there are few options available to such personnel.

One known option is a foldable armor curtain which may be stored inconspicuously in a briefcase or other carrying device but provides only limited protection for the user, who must hold up and hide behind the curtain, similar to an oversized shield carried by a medieval knight. Furthermore, such devices obstruct the user's vision and maneuverability and provide no back protection.

Another known option is a two piece armor "vest" where the two pieces zip together to form a rifle/gun bag. However, such devices are large and conspicuous, thereby providing minimal, if any concealment of the armor and/or other tactical gear. Furthermore, the two pieces lack any of the shaping or tailoring found in a true tactical vest.

Additionally, these known options do not offer means for attaching or configuring other tactical gear such as ammunition, mace, radios, stun guns, etc. Therefore, a user of such options is provided with only limited protection while suffering from minimal concealment of the equipment, restricted movement, and a tactical disadvantage caused by having insufficient available gear arranged in an unfamiliar configuration.

In other applications, various activities such as, for example, hunting, hiking, camping, boating, canoeing/kayaking, fishing, diving, etc. also require important gear and/or tools. This gear, e.g., fishing lures, fishing hooks, whistles, rations, ammunition, floatation, tools, knives, flashlights, axes, and/or any other suitable equipment can sometimes be kept in a carried bag or pack, but participation in the activities can, at times, dictate that some gear must be kept on the person of a participant in the activity. Garments such as hunting vests or fishing vests generally serve a specific purpose, e.g., increasing observability of the wearer or holding a small amount of fishing equipment, but overall provide minimal functionality for the user. No options exist to such participants for a means of rapidly transferring gear from a bag or pack onto the participant's person in the participant's preferred configuration.

SUMMARY OF THE INVENTION

It would be desirable to produce a combination bag/vest which, in a bag configuration, serves as a functional bag and which, in a vest configuration, includes a system for attaching one or more accessories in a desired configuration. It would also be desirable to produce such combination bag/vests wherein the vest configuration operates as a tactical personal body armor vest and the bag configuration conceals the tactical vest portion while permitting the one or more accessories to remain in the desired configuration.

Described herein are devices and techniques for solving the problems, such as limited protection, restriction of movement, conspicuousness, and the inability to deploy tactical gear, associated with current body armors and for providing participants in various activities a means of rapidly transferring gear from a bag or pack onto the participant's person in the participant's preferred configuration. The combination bag/vest described herein includes a vest portion having a chest covering portion, shoulder straps, and a back covering portion and a system for attaching modular accessories to the chest and/or back covering portions. The combination bag/vest also includes a bag portion having a back bag layer and a chest bag layer attached to the back and chest portions, respectively, and a fastener for connecting the back bag layer to the chest bag layer. In a bag configuration the system for attaching modular accessories and any attached accessories face inward and the back and chest bag layers face outward. In a vest configuration the system for attaching modular accessories and any attached accessories face outward and the back and chest bag layers face a chest and a back of a wearer of the vest.

In one aspect, at least one embodiment described herein provides a combination bag/vest. The combination bag/vest includes a vest. The vest includes a chest covering portion and a back covering portion. The vest also includes a central portion including shoulder straps, the shoulder straps connecting an upper end of the chest covering portion to an upper end of the back covering portion. The vest also includes a modular accessory attachment system disposed on a vest surface of the chest and/or back covering portions for attaching one or more modular accessories to the chest and/or back covering elements in a desired configuration.

The combination bag/vest also includes a bag. The bag includes at least one back bag layer attached to the back covering portion opposite the vest surface. The bag also includes at least one chest bag layer attached to the chest covering portion opposite the vest surface. The bag also includes at least one fastener for fastening the back bag layer to the chest bag layer. The combination bag/vest wherein, in a vest configuration, the vest surface of the outer chest and/or back textile layers faces away from a wearer of the vest. The combination bag/vest wherein, in a bag configuration, the at least one back bag layer and the at least one chest bag layer are at least partially fastened and face outward and the vest surface of the chest and/or back covering portions faces inward. The combination bag/vest wherein the desired configuration of the one or more modular accessories attached to the modular accessory attachment system on the vest surface of the chest and/or back covering portions is maintained in both the vest configuration and the bag configuration.

Any of the embodiments described herein can include one or more of the following embodiments. In some embodiments, the at least one fastener is a zipper. In some embodiments, the vest further comprises at least one securing device for securing the vest to the wearer by securing a lower end of the back covering portion to a lower end of the chest covering portion. In some embodiments, in the bag configuration, the combination bag/vest is configured to appear to be one or more of a briefcase, a backpack, a duffel bag, a laptop case, a beach bag, a diaper bag, a satchel, and/or a purse. In some embodiments, in the bag configuration, the bag functions as the one or more of a briefcase, a backpack, a duffel bag, a laptop case, a beach bag, a diaper bag, a satchel, and/or a purse, the concealment portion including one or more compartments and/or pockets.

In some embodiments, the vest further comprises one or more PALS webbing elements disposed on a surface of the shoulder straps for routing at least one tube and/or wire between the chest covering portion and the back covering portion. In some embodiments, the combination bag/vest further comprises at least one closeable chest pouch defined in the chest covering portion between an outer chest textile layer and an interior chest textile layer for receiving one or more inserts and/or at least one closeable back pouch defined in the back covering portion between an outer back textile layer and an interior back textile layer for receiving one or more inserts. In some embodiments, the at least one closeable back pouch and/or the at least one closeable chest pouch are configured to receive one or more armor plates. In some embodiments, the at least one closeable back pouch and/or the at least one closeable chest pouch are configured to receive one or more floatation elements. In some embodiments, the at least one closeable back pouch and/or the at least one closeable chest pouch are configured to receive one or more insulation elements. In some embodiments, the chest covering portion and/or the back covering portion includes an insulating layer and at least one reflective element disposed on the vest surface.

In some embodiments, the chest covering portion and/or the back covering portion includes one or more side covering portions. In some embodiments, the one or more side covering portions further comprise at least one closeable side pouch defined in the one or more side covering portions between an outer side textile layer and an interior side textile layer for receiving one or more inserts. In some embodiments, the modular accessory attachment system includes a plurality of Pouch Attachment Ladder System (PALS) webbing elements attaching one or more Modular Lightweight Load-carrying Equipment (MOLLE)-compatible accessories to the chest and/or back covering elements in a desired configuration.

In one aspect, at least one embodiment described herein provides a concealable body armor. The concealable body armor includes an armor vest. The vest includes a chest covering portion and a back covering portion. The vest also includes a central portion including shoulder straps, the shoulder straps connecting an upper end of the chest covering portion to an upper end of the back covering portion. The vest also includes at least one closeable chest pouch defined in the chest covering portion between an outer chest textile layer and an interior chest textile layer for receiving one or more armor plates. The vest also includes at least one closeable back pouch defined in the back covering portion between an outer back textile layer and an interior back textile layer for receiving one or more armor plates. The vest also includes a plurality of Pouch Attachment Ladder System (PALS) webbing elements disposed on a surface of the outer chest and/or back textile layers for attaching one or more Modular Lightweight Load-carrying Equipment (MOLLE)-compatible accessories to the chest and/or back covering elements in a desired configuration.

The concealable body armor also includes a concealment portion. The concealment portion includes at least one back concealment layer attached to the interior back textile layer opposite the outer back textile layer. The concealment portion also includes at least one chest concealment layer attached to the interior chest textile layer opposite the outer chest textile layer. The concealment portion also includes at least one fastener for connecting the back concealment layer to the chest concealment layer. The concealable body armor wherein, in a deployed state, the at least one back concealment layer and at least one chest concealment layer face a back and a chest, respectively, of a wearer of the armor vest. The concealable body armor wherein, in a concealed state, the at least one back concealment layer and at least one chest concealment layer are at least partially fastened and face outward and the outer chest and back textile layers face inward. The concealable body armor wherein the desired configuration of the one or more MOLLE-compatible accessories attached to the plurality of PALS webbing elements on the chest and back covering portions is maintained in both the deployed state and the concealed state.

Any of the embodiments described herein can include one or more of the following embodiments. In some embodiments the at least one closeable back pouch and the at least one closeable chest pouch are configured to receive the one or more armor plates in any size up to 11 inches in width and 14 inches in height. In some embodiments, in the concealed state, the concealable body armor is configured to appear to be one or more of a briefcase, a backpack, a duffel bag, a laptop case, a beach bag, a diaper bag, a satchel, and/or a purse. In some embodiments, in the concealed state, the concealable body armor functions as the one or more of a briefcase, a backpack, a duffel bag, a laptop case, a beach bag, a diaper bag, a satchel, and/or a purse, the concealment portion including one or more compartments and/or pockets. In some embodiments, the chest covering portion and/or the back covering portion includes one or more side covering portions. In some embodiments, the one or more side covering portions further comprise at least one closeable side pouch defined in the one or more side covering portions between an outer side textile layer and an interior side textile layer for receiving one or more armor plates. In some embodiments, the vest further comprises one or more PALS webbing elements disposed on a surface of the shoulder straps for routing at least one tube and/or wire between the chest covering portion and the back covering portion.

BRIEF DESCRIPTION OF THE DRAWINGS

One will better understand these and other features, aspects, and advantages of the present invention following a review of the description, appended claims, and accompanying drawings:

DETAILED DESCRIPTION

Described herein are combination bag/vests which, in a bag configuration, serve as a functional bag and which, in a vest configuration, include a system for attaching one or more accessories in a desired configuration. Also described herein are such combination bag/vests wherein the vest configuration operates as a tactical personal body armor vest and the bag configuration conceals the tactical vest portion while permitting the one or more accessories to remain in the desired configuration.

The combination bag/vests described herein include a vest portion having a chest covering portion, shoulder straps, and a back covering portion and a system for attaching modular accessories to the chest and/or back covering portions. The combination bag/vest also includes a bag portion having a back bag layer and a chest bag layer attached to the back and chest portions, respectively, and a fastener for connecting the back bag layer to the chest bag layer. In a bag configuration the system for attaching modular accessories and any attached accessories face inward and the back and chest bag layers face outward. In a vest configuration the system for attaching modular accessories and any attached accessories face outward and the back and chest bag layers face a chest and a back of a wearer of the vest.

Although the combination bag/vest is illustrated herein to show an exemplary briefcase/body armor vest, it will be apparent in view of this disclosure that any number of bag and/or vest configurations can be used. For example, the bag configuration can appear to be and/or function as a briefcase, a backpack, a duffel bag, a laptop case, a beach bag, a diaper bag, a satchel, a purse, and/or any other suitable bag or luggage. The vest configuration can be a simple textile vest or can be configured to contain floatation elements, armor plates, insulation elements, and/or any other suitable features. Additionally, the configuration and appearance of the vest can be designed for various specific applications such as, for example, a hunting vest, a construction crew vest, a fishing vest, a diving or snorkeling vest, a canoeing or kayaking vest, a personal floatation device, and/or a vest for any other purpose.

Figure 1:
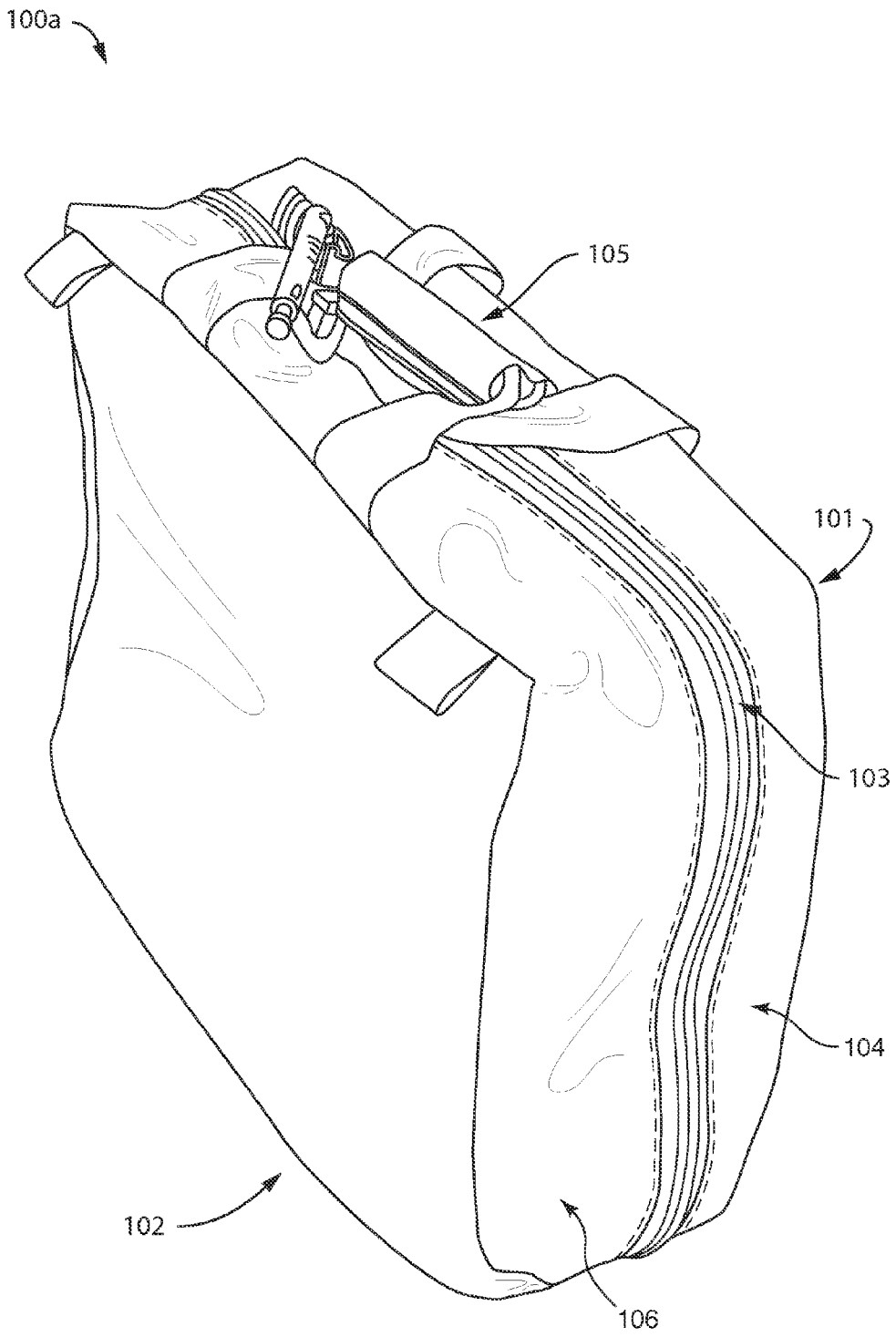
FIG. 1 is an isometric view of a combination bag/vest in a bag configuration in accordance with various embodiments.
Figure 2:
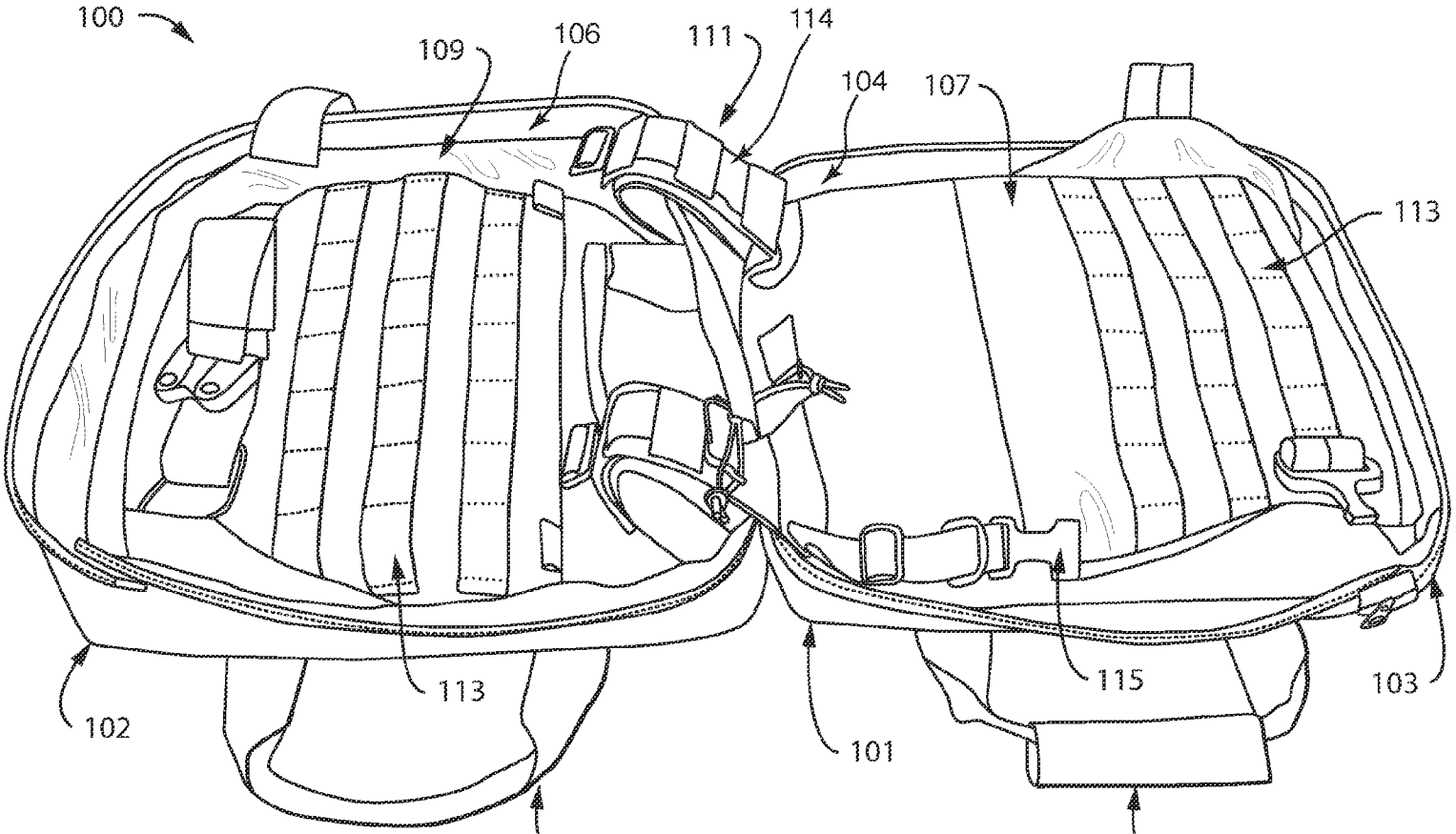
FIG. 2 is an isometric view of a combination bag/vest in a partially deployed configuration in accordance with various embodiments.
Figure 3:
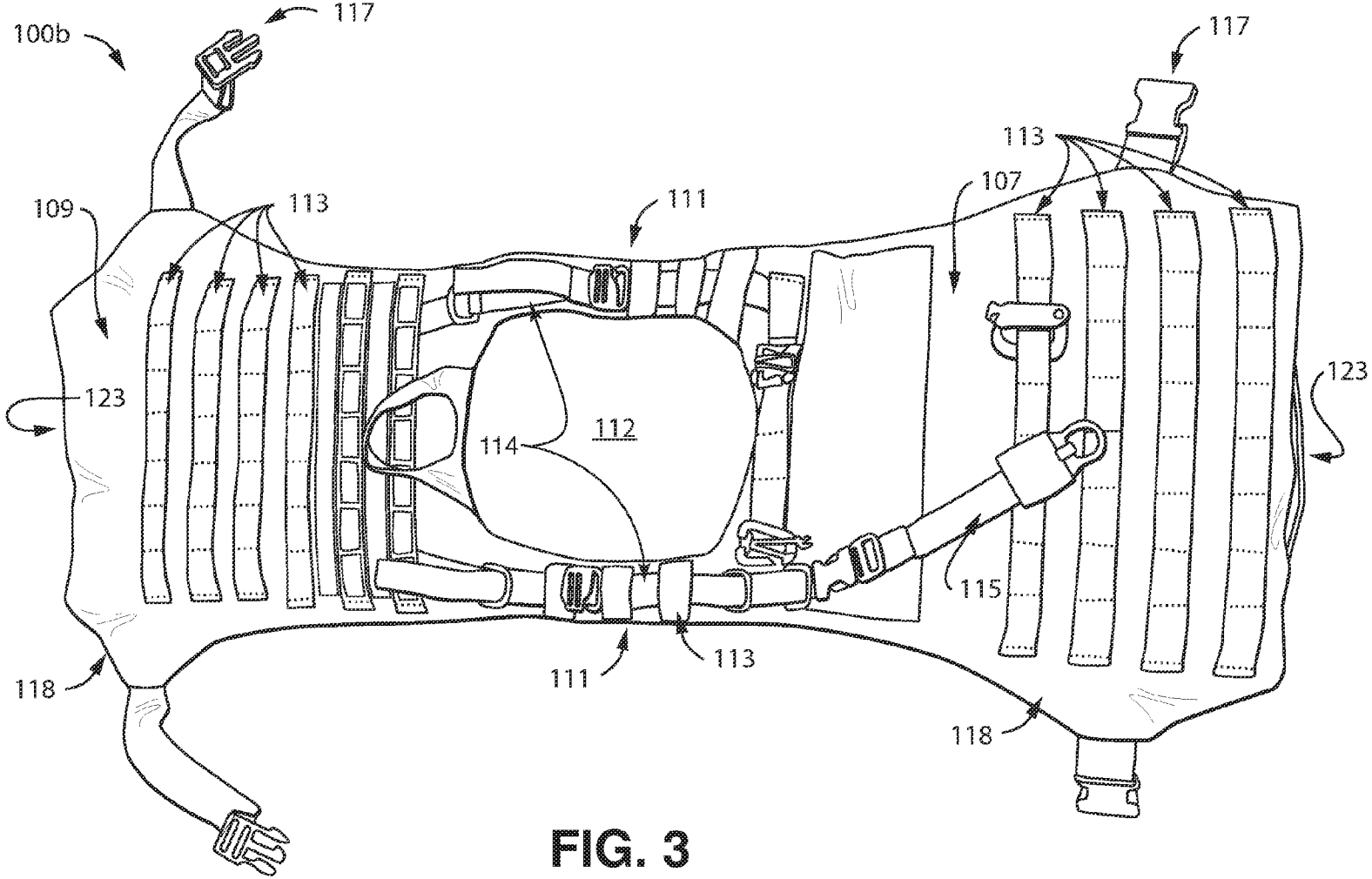
FIG. 3 is a top view of a combination bag/vest in fully deployed, unworn vest configuration in accordance with various embodiments.
Figure 4:
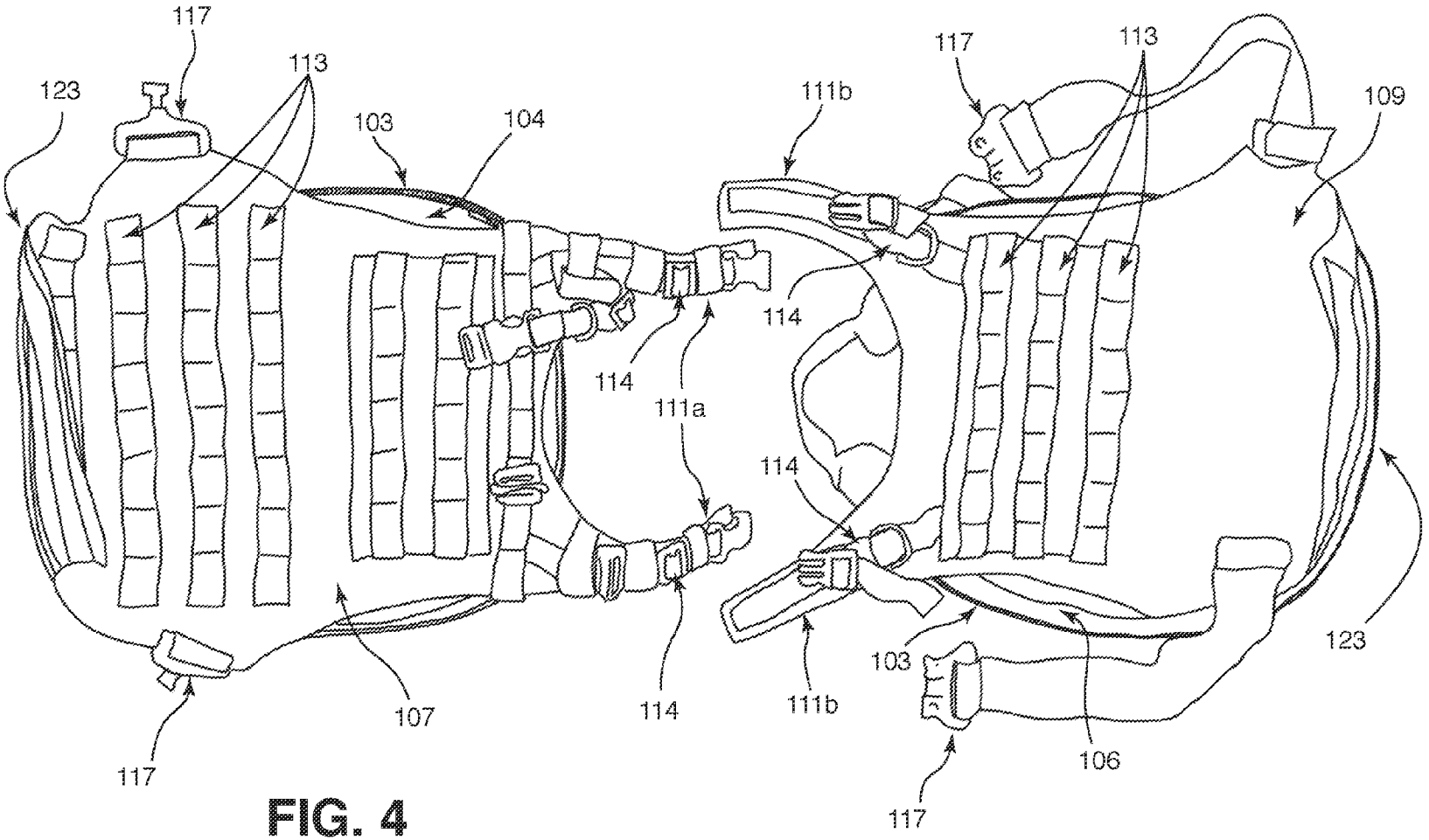
FIG. 4 is a top view of a combination bag/vest in separated, unworn vest configuration in accordance with various embodiments.
Figure 5:
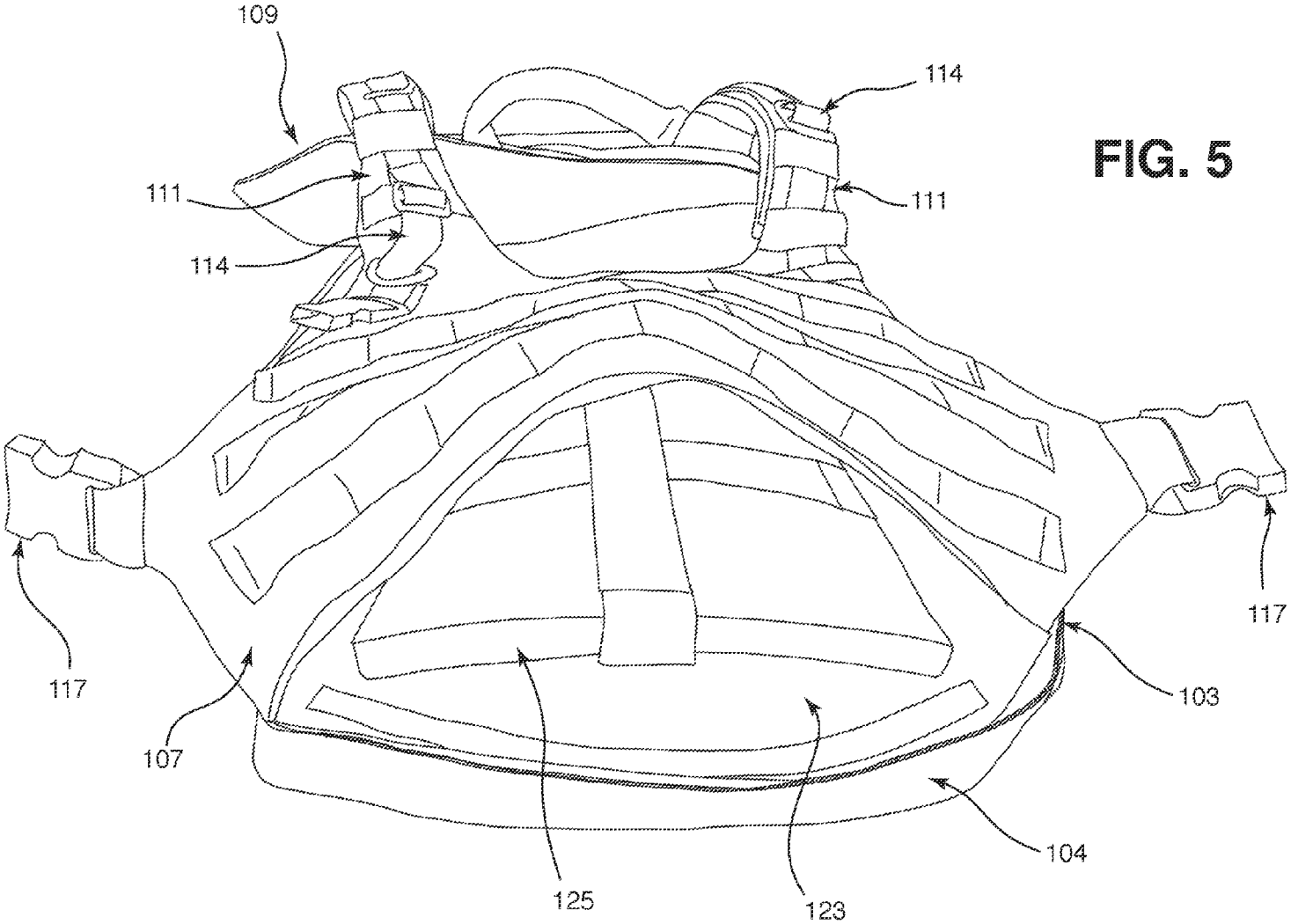
FIG. 5 is a front bottom view of a combination bag/vest in accordance with various embodiments.
Figure 6:
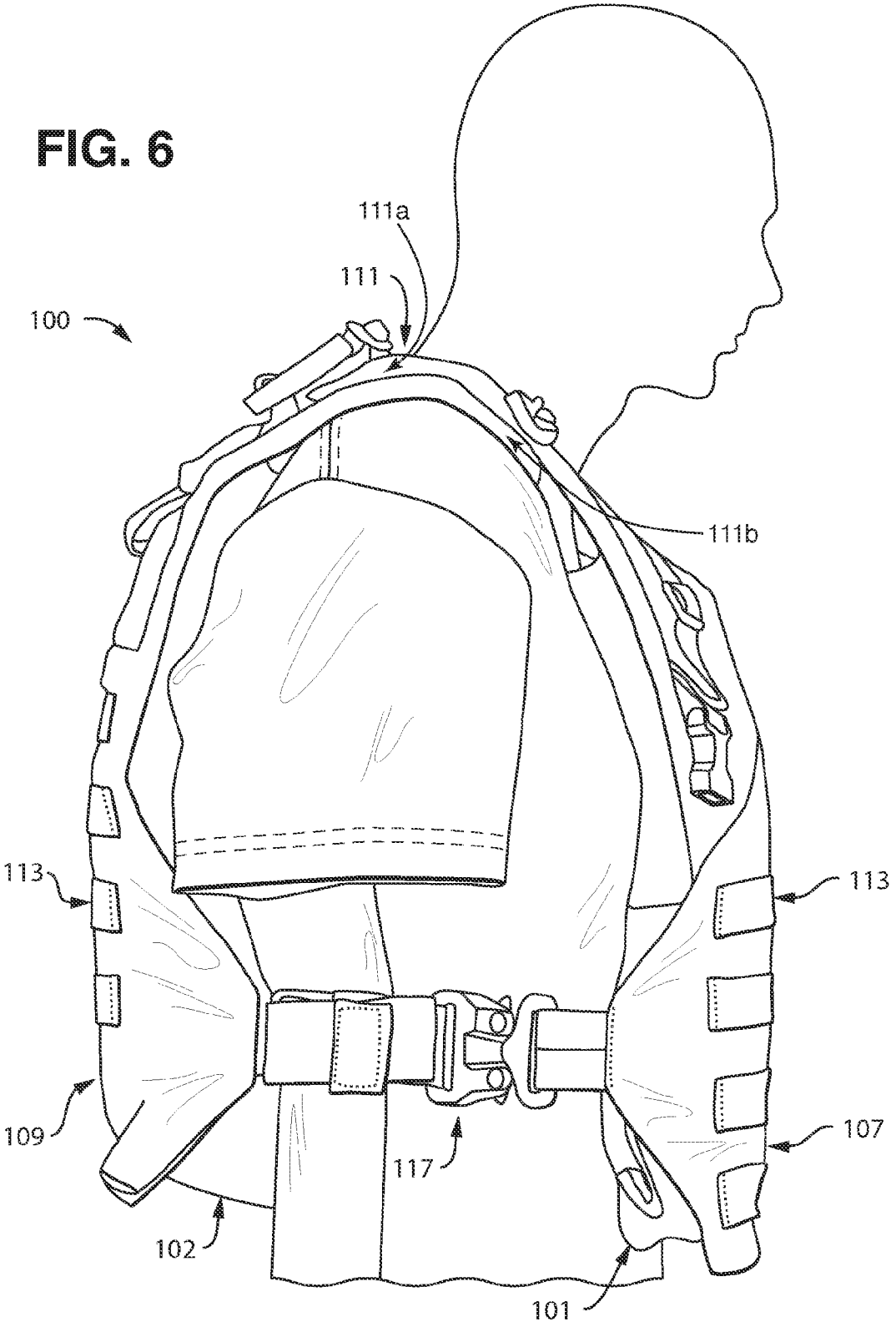
FIG. 6 is a side view of a combination bag/vest in a vest configuration and in accordance with various embodiments.

As shown in FIGS. 1-9, various embodiments of a combination bag/vest 100 include a bag 100*a* and a vest 100*b*. As best shown in FIGS. 3, 4, and 6 the vest 100*b*, in accordance with various embodiments, includes a chest covering portion 107 for being worn over a chest of a wearer of the vest 100*b*, a back covering portion 109 for being worn over a back of the wearer, and shoulder straps 111 defining a head opening 112 for being worn on shoulders of the wearer and for connecting an upper portion of the chest covering portion 107 with an upper portion of the back covering portion 109. As best shown in FIGS. 1 and 2, the bag 100*a* includes a chest bag layer 101 attached to the chest covering portion 107 of the vest 100*b*, a back bag layer 102 attached to the back covering portion 109 of the vest 100*b*, and a fastener 103, e.g., a zipper as shown, for connecting the chest bag layer 101 to the back bag layer 102. In a bag 100*a* configuration the chest covering portion 107 and the back covering portion 109 face inward and the chest 101 and back 102 bag layers face outward. In a vest 100*b* configuration the chest covering portion 107 and the back covering portion 109 face outward and the chest 101 and back 102 bag layers face a chest and a back of a wearer of the vest as shown, for example, in FIGS. 6 and 7.

As best shown in FIGS. 1 and 2, the fastener 103 may be disposed along a chest fastener band 104 and a back fastener band 106. The chest 104 and back 106 fastener bands each connect to and extend from the appropriate bag layer, i.e., the chest fastener band 104 connects to and extends from the chest bag layer 101, and the back fastener band 106 connects to and extends from the back bag layer 102. When attached using the fastener 103, the chest fastener band 104 and the back fastener band 106 provide the bag 100*a* with sufficient depth to adequately conceal any equipment fastened to the chest covering portion 107 or the back covering portion 109. As depicted in FIG. 1, the back fastener band 106 may be wider than the chest fastener band 104 to ensure that the chest fastener band 104 does not interfere with the user during operation in the vest 100*b* configuration. However, in some embodiments the chest fastener band 104 may be wider than the back fastener band 106 or the chest 104 and back 106 fastener bands may be the same width.

Figure 7:
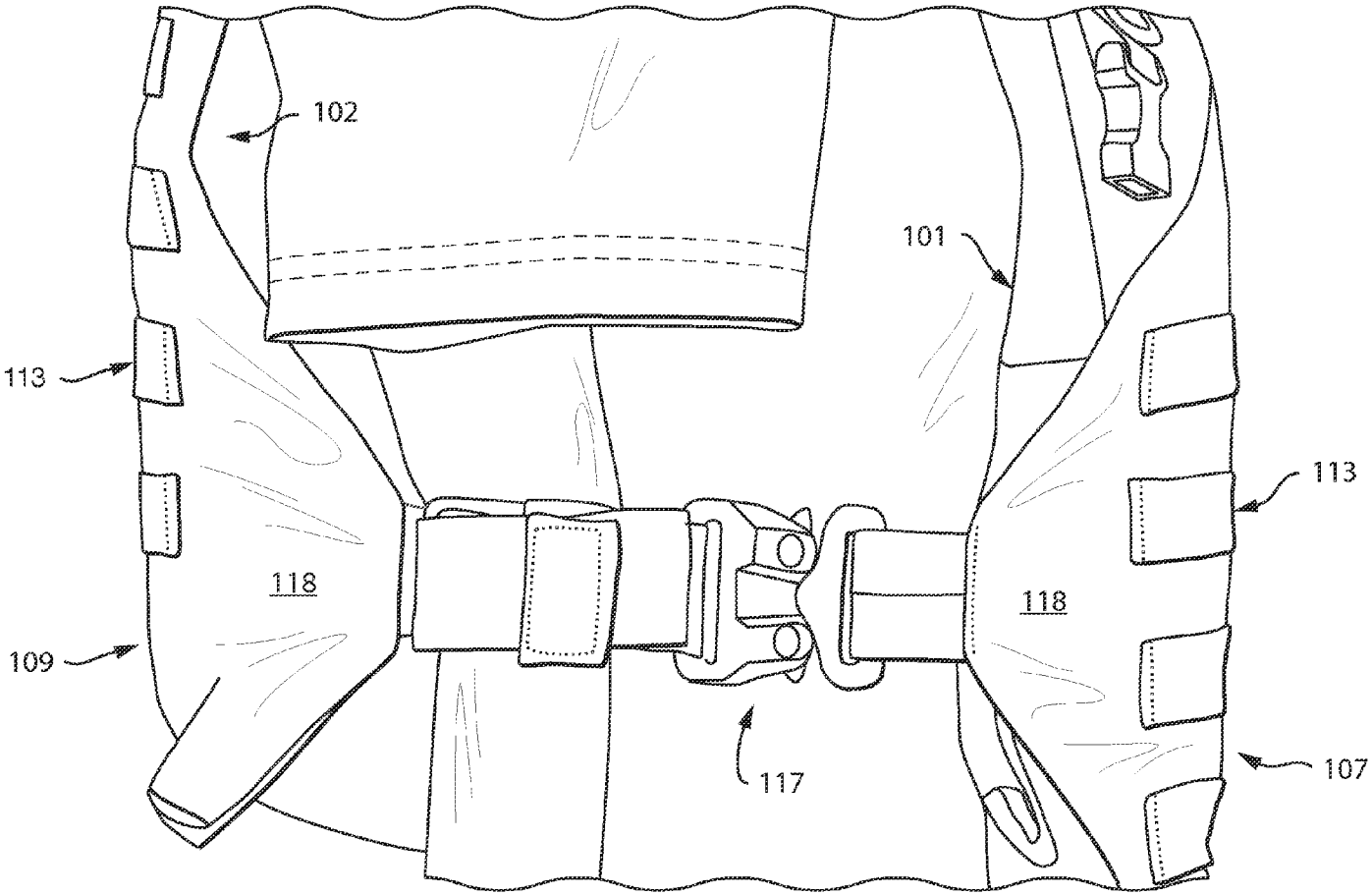
FIG. 7 is a close up side view of a combination bag/vest in a vest configuration in accordance with various embodiments.

As shown in FIGS. 1-7, in accordance with various embodiments, when the combination bag/vest 100 is in the bag 100*a* configuration and the vest 100*b* is concealed by the bag 100*a*, e.g., as shown in FIG. 1, a wearer can convert the combination bag/vest 100 from a bag 100*a* configuration to a vest 100*b* configuration in three simple steps. First, the wearer uses the fastener 103 to unfasten the chest bag layer 101 of the bag 100*a* from the back bag layer 102 of the bag 100*a*, e.g., as shown in FIG. 2. Second, the wearer separates the chest and back bag layers 101, 102 to reveal the chest covering portion 107 of the vest 100*b*, the back covering portion 109 of the vest 100*b*, and the head opening 112 defined by the shoulder straps, e.g., as shown in FIG. 3. Third, the wearer then passes his or her head through the head opening 112 with the chest and back covering portions 107, 109 facing outward and secures one or more securing devices 117 around his or her torso, e.g., as shown in FIGS. 6 and 7, at which point the vest 100*b* is deployed and ready for use by the wearer.

Figure 10:
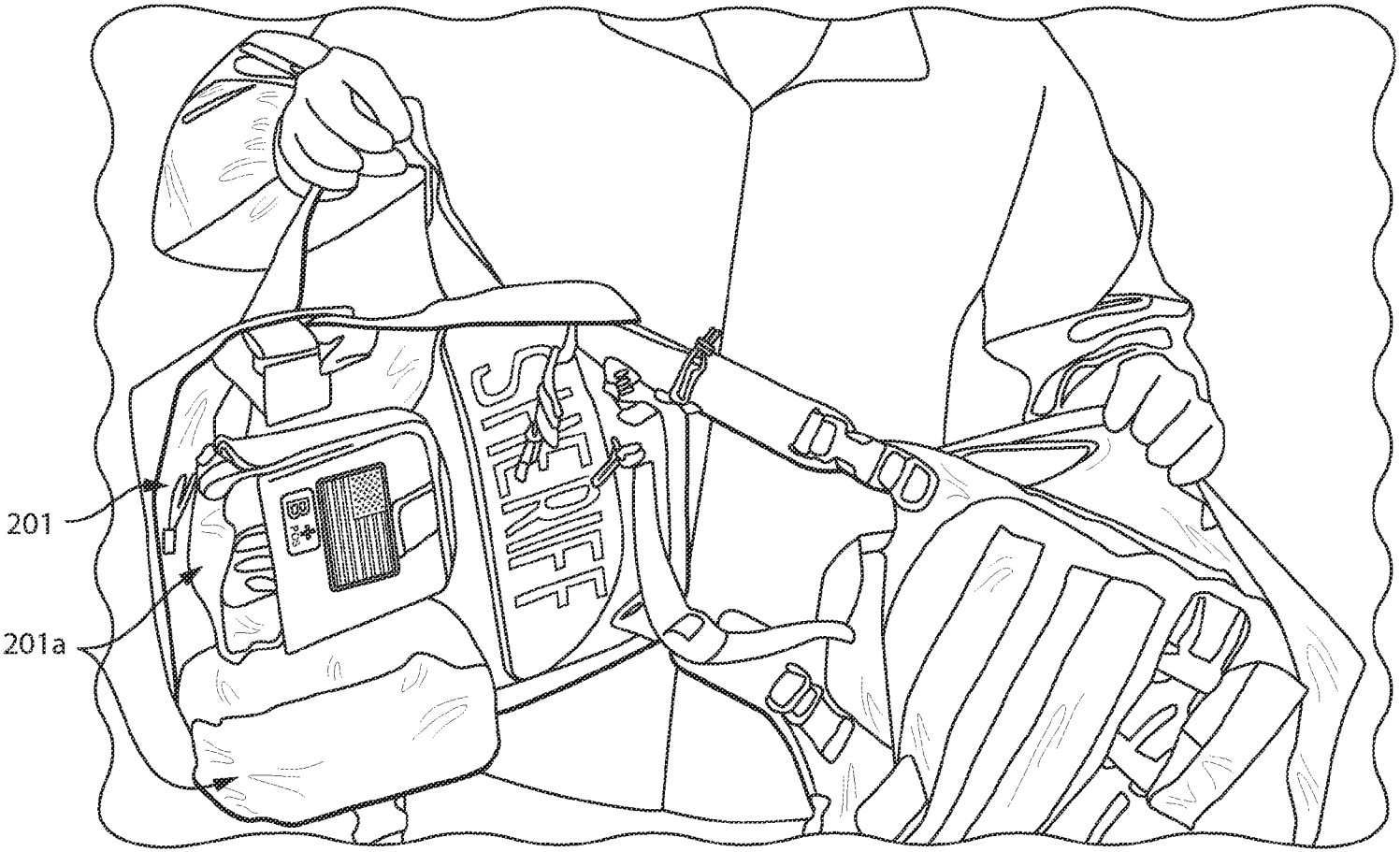
FIG. 10 is an isometric view of a partially deployed combination bag/vest having pre-configured modular accessories equipped thereon in accordance with various embodiments.

As shown in FIG. 10, in accordance with various embodiments, maximum efficiency in establishing tactical readiness can be achieved by configuring one or more modular accessories 201 on a modular accessory attachment system 113 on the chest and/or back covering portions 107, 109 prior to use so that the wearer's desired complement and configuration of equipment is available for use upon full deployment of the vest 100*b*.

The shoulder straps 111 are configured for being worn on the shoulders of the wearer and for connecting an upper portion of the chest covering portion 107 with an upper portion of the back covering portion 109. The shoulder straps 111, in cooperation with the chest covering portion 107 and back covering portion 109 define a head opening 112 for passing the head and neck of the wearer, allowing the shoulder straps 111 to rest on the shoulders of the wearer. In accordance with various embodiments, the shoulder straps 111 can be adjustable (as shown) and/or fixed in length. In accordance with various embodiments, the shoulder straps 111 can be simple straight straps or can be shaped and/or padded for added ergonomic function and wearer comfort.

As shown in FIG. 6, the shoulder straps 111 may be formed by overlapping a chest strap portion 111*a* and a back strap portion 111*b*. In this embodiment, the chest strap portion 111*a* and the back strap portion 111*b* may overlay each other, providing a degree of movement to ensure proper positioning of the shoulder straps 111 when resting on the shoulders of the wearer. One of skill in the art will appreciate that the chest strap portion 111*a* and the back strap portion 111*b* may be temporarily secured using hook and loop fasteners, buttons, snaps, laces, hook-and-eye, buckles, or a combination thereof. Removably securing the chest strap portion 111*a* and the back strap portion 111*b* provides the additional benefit of allowing the user to adjust the shoulder straps 111 to the correct size, without worrying that the shoulder straps 111 will shift as a result of putting the vest 100*b* on or taking the vest 100*b* off. In embodiments where the shoulder straps 111 are formed by overlaying chest 111*a* and back 111*b* strap portions, it is preferable that reinforcing straps 114, which connect to the chest covering portion 107 and the back covering portion 109 as best shown in FIG. 3, reinforce the shoulder straps 111. When included, the reinforcing straps 114 may be removably secured using a buckle or other fastener as known in the art.

As best shown in FIG. 4, a pair of chest strap portions 111*a* extend from the chest covering portion 107, while a pair of back strap portions 111*b* extend from the back covering portion 109. As depicted in FIG. 6, each of the chest strap portions 111*a* overlaps the corresponding back strap portion 111*b*, to form a shoulder strap 111. As depicted in FIG. 4, the chest strap portions 111*a* and the back strap portions 111*b* are distinct sections. As will be readily apparent to one of skill in the art, the chest strap portion 111*a* and the back strap portion 111*b* may be overlapped such that either portion is on top without deviating from the scope of the present invention.

The chest covering portion 107 and the back covering portion 109 may be separated completely by separating the chest strap portion 111*a* and the back strap portion 111*b* as shown in FIG. 4. In embodiments where a reinforcing strap 114 is present, complete separation further requires separating the reinforcing straps 114. Complete separation of the chest covering portion 107 and the back covering portion 109 is advantageous because it allows users to preconfigure one or more additional chest covering portions 107 and/or one or more back covering portions 109 with one or more modular accessories 201 on a modular accessory attachment system 113. These preconfigured chest covering portions 107 and/or back covering portions 109 may then be quickly and easily interchanged, so that the wearer's desired compliment and configuration of equipment is available for use upon full deployment of the vest 100*b*.

The chest covering portion 107, the back covering portion 109 of the vest 100*b* include at least one textile layer, which can be constructed of any suitable material, including for example but not limited to, nylon, cotton, polyester, polypropylene, wool, leather, Kevlar, canvas, any woven textile, any non-woven textile, any tricot, any knit textile, and/or any other suitable material. In accordance with various embodiments, the chest covering portion 107 and/or the back covering portion 109 includes one or more closeable pouches 123 defined by an outer textile layer and an inner textile layer. As best shown in FIG. 5, the closeable pouches 123 can be configured for receiving one or more inserts 125. Inserts 125, in accordance with various embodiments, can include armor plates, trauma plates, floatation elements, insulation elements, padding elements, heating elements, cooling elements, hydration system bladders, and/or any other suitable insert 125. In accordance with various embodiments, armor and/or trauma plate inserts 125 can be of any type, protection rating, size, and/or shape e.g., conforming to one or more size and/or performance requirements prescribed by the U.S. National Institute of Justice (NIJ) standards, the UK Home Office Scientific development branch standards, U.S. Armed Forces Small Arms Protective Insert (SAPI) standards, U.S. Armed Forces Enhanced Small Arms Protective Insert (ESAPI) standards, and/or any other standard.

As shown in FIG. 3, in accordance with various embodiments, the chest covering portion 107 and/or the back covering portion 109 can include one or more optional side covering portions 118. The side covering portions 118 shown in FIG. 3 are small extensions of the one or more textile layers to provide improved fit and a more stable securing of the vest to the wearer. However, it will be apparent in view of this disclosure that the side covering portions can also include more comprehensive side coverage. In such embodiments the side covering portions can include one or more closeable side pouches, defined by an outer textile layer and an inner textile layer, similar to the chest and/or back closeable pouches 123. The closeable side pouches can, in accordance with various embodiments, be configured to receive one or more side inserts, which, can be, but are not limited to, the inserts 125 described above with reference to the chest and/or back closeable pouches 123.

As shown in FIGS. 3-7, the vest 100*b* can, in accordance with various embodiments, include one or more securing devices 117 for securing a lower end of the chest covering portion 107 with a lower end of the back covering portion 109. Securing devices 117 can be, for example, one or more of a belt, a strap, an adjustable strap, laces, a buckle, a clip, a ratchet strap, and/or any other suitable securing device. In accordance with various embodiments, the securing devices can be attached to the chest covering portion 107 and/or the back covering portion 109. In accordance with various embodiments having side covering portions 118, the securing devices 117 can be attached to the side covering portions 118.

Figure 8:
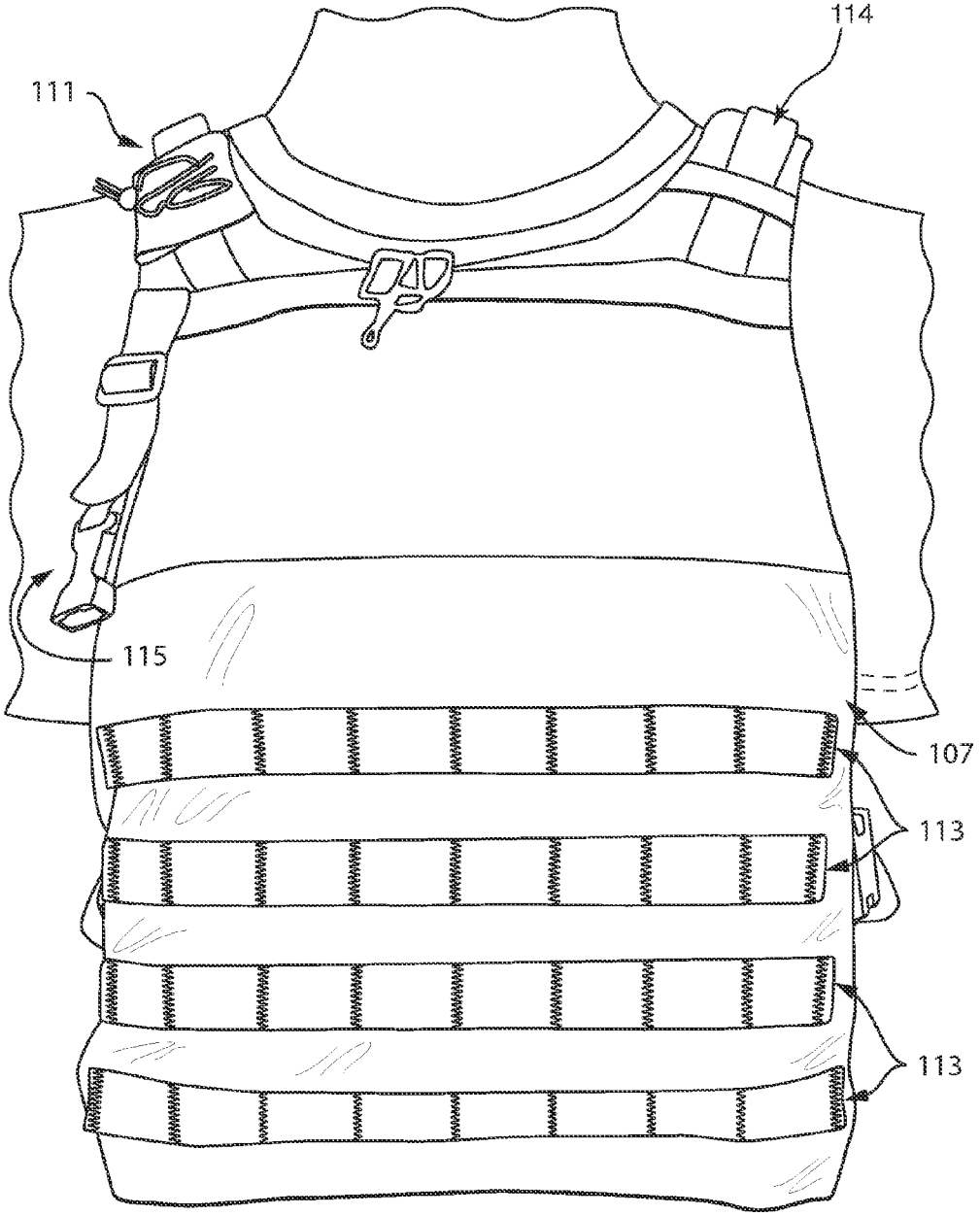
FIG. 8 is a view of a chest portion of a combination bag/vest in a vest configuration in accordance with various embodiments.
Figure 9:
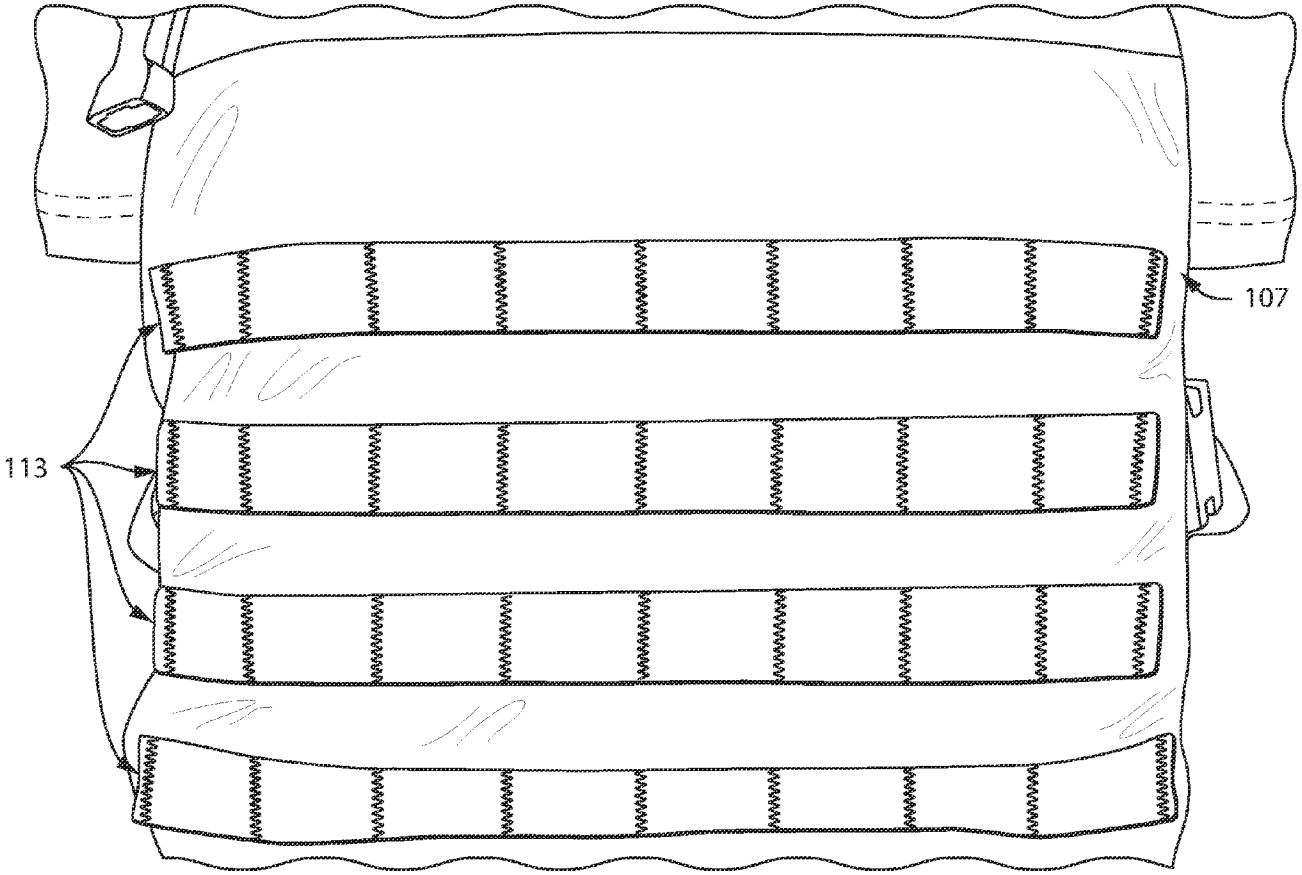
FIG. 9 is a close up view of a chest portion of a combination bag/vest showing PALS webbing in accordance with various embodiments.
Figure 11:
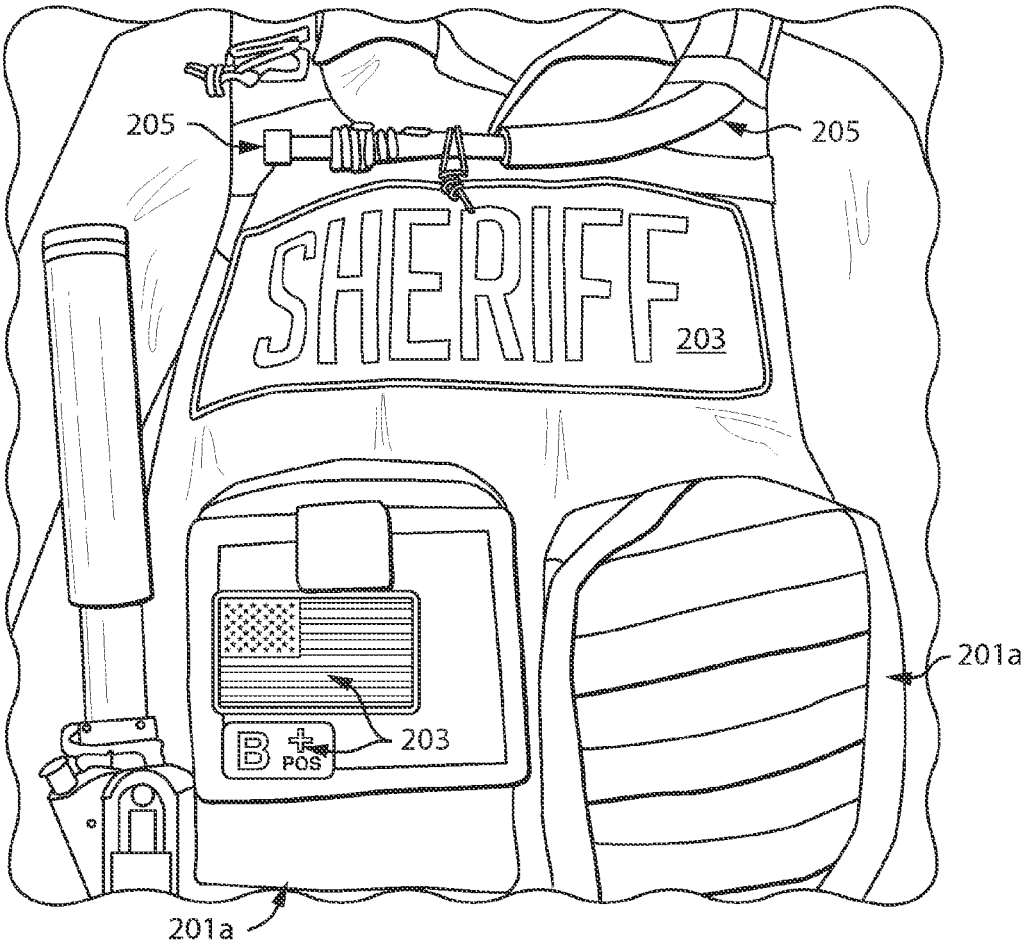
FIG. 11 is a view of a chest portion of a combination bag/vest having modular accessories equipped thereon in a first configuration in accordance with various embodiments.
Figure 12:
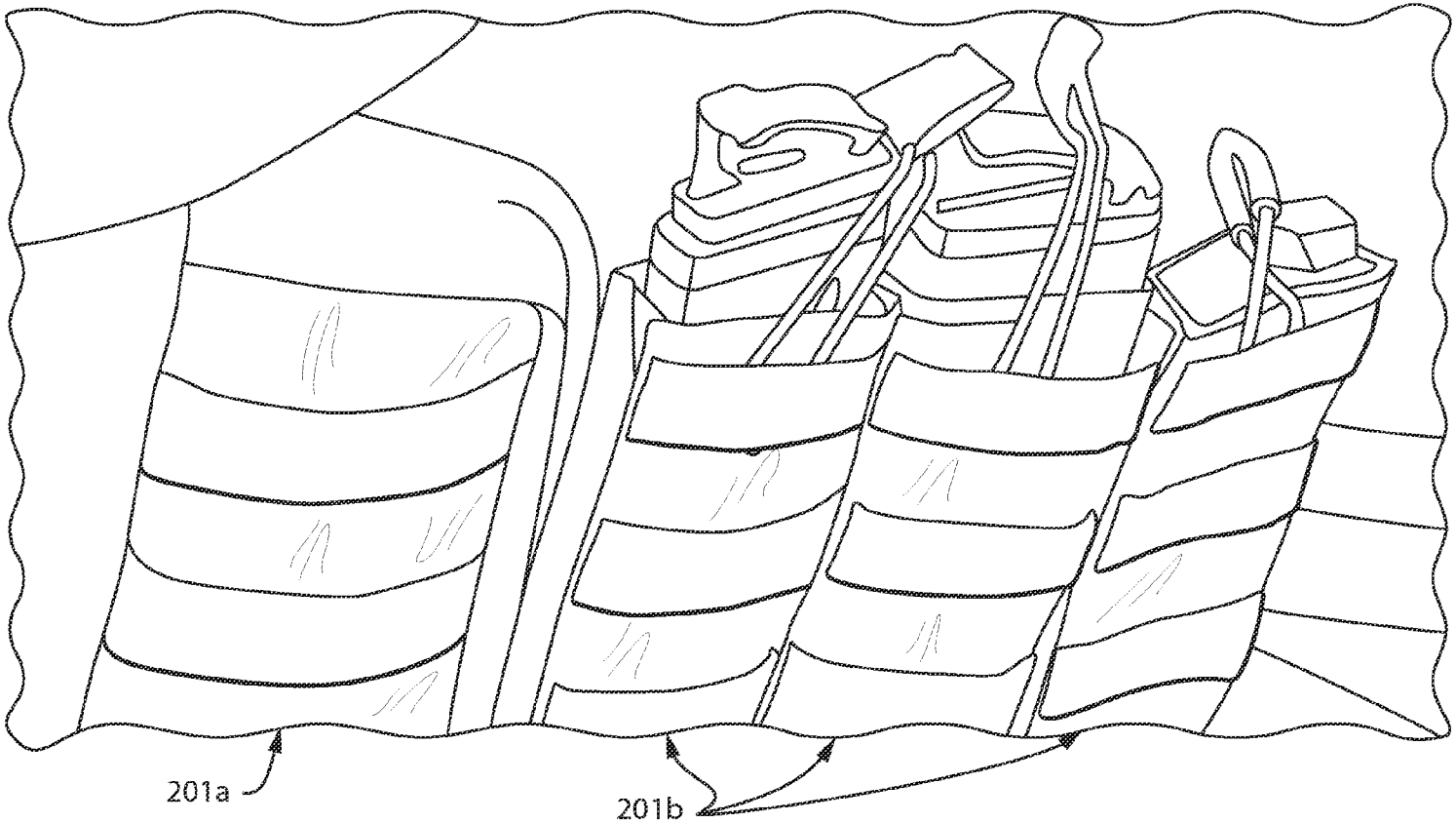
FIG. 12 is a close up view of a chest portion of a combination bag/vest having modular accessories equipped thereon in a second configuration in accordance with various embodiments.

As best shown in FIGS. 3, 8, and 9, the chest covering portion 107 and/or the back covering portion 109 of the vest 100*b* includes a modular accessory attachment system 113. As shown, the modular accessory attachment system 113 includes a plurality of Pouch Attachment Ladder System (PALS) webbing elements disposed on a vest surface, i.e., the surface that faces outward when the vest 100*b* is being worn, of the chest covering portion 107 and/or the back covering portion 109 for attaching one or more modular accessories 201, e.g., Modular Lightweight Load-carrying Equipment (MOLLE)-compatible accessories 201*a*, 201*b* as shown in FIGS. 10-12. The modular accessory attachment system 113 advantageously allows a wearer of the vest 100*b* to attach one or more modular accessories to the vest 100*b* in any configuration desired by the user. It will be apparent in view of this disclosure that any other modular accessory attachment system 113 such as, for example, loop and/or hook fabric for mating with hook and/or loop fabric on one or more modular accessories, snaps for snapping on accessories, and/or any other suitable system can also be used in accordance with various embodiments.

By way of example, as shown in FIG. 11, the wearer of the vest 100*b* has attached two modular accessories 201 to the chest covering portion 109 in a first configuration which includes two MOLLE-compatible pouch accessories 201*a*. As shown in FIG. 12, a different wearer of the vest 100*b* has attached four modular accessories 201 to the chest covering portion 109 in a second configuration which includes one MOLLE-compatible pouch accessory 201*a* and three MOLLE-compatible ammunition clip holder accessories 201*b*. It will be apparent in view of this disclosure that the first and second configurations are provided for example only and that any type and/or number of modular accessories 201 can be attached to the chest covering portion 107, the back covering portion 109, and/or the shoulder straps 111 in any configuration desired by the wearer.

As best shown in FIG. 10, which shows a combination bag/vest 100 having been partially converted from the bag 100*a* configuration into the vest 100*b* configuration, the combination bag/vest 100 is advantageously designed to convert between the bag 100*a* configuration and the vest 100*b* configuration with the one or more modular accessories 201 attached to the modular accessory attachment system 113. This design allows the vest 100*b* to be deployed with all of the modular accessories 201 already attached and in the configuration preferred by the wearer. The time required to achieve full deployment is therefore advantageously reduced and the wearer suffers none of the tactical disadvantages associated with unfamiliar equipment configurations.

As shown in FIGS. 3 and 11, the modular accessory attachment system 113 can also be disposed on one or more of the shoulder straps 111. In accordance with various embodiments, PALS webbing elements can be disposed on the shoulder straps 111 for attaching modular accessories 201 and/or for routing one or more wires and/or tubes 205 between the back covering portion 109 and the chest covering portion 107. Such wires and/or tubes 205 can include, for example but not limited to, radio wires, hydration tubes (as shown in FIG. 11), oxygen/breathing tubes, and/or electrical power cords.

As best shown in FIGS. 3 and 11, the chest covering portion 107, back covering portion 109, and/or shoulder straps 111 of vest 100*b* can also include additional features such as, for example, a gear attachment member 115 and/or loop fabric for retaining an informational placard 203 and/or other additional gear. Gear attachment members 115, in accordance with various embodiments, can include any clip, buckle, and/or any other type of releasable attachment suitable for attaching a weapon, e.g., a gun as shown in FIG. 11, a whistle, an oar or paddle, an electronic device, and/or any other gear desired by the wearer. Placards 203, in accordance with various embodiments, can include any patches, nametags, or other devices mateable with loop fabric. Such placards 203, in accordance with various embodiments, can be configured to convey any desired information, e.g., displaying an American flag, identifying the wearer as "SHERRIF", and/or providing medical information such as blood type as shown in FIG. 11.

As best shown in FIGS. 1 and 2, the bag 100*a* includes a chest bag layer 101 attached to the chest covering portion 107 of the vest 100*b*, a back bag layer 102 attached to the back covering portion 109 of the vest 100*b*, and a fastener 103, e.g., a zipper as shown, for connecting the chest bag layer 101 to the back bag layer 102. In the bag 100*a* configuration, the chest covering portion 107 and the back covering portion 109 face inward and the chest 101 and back 102 bag layers face outward. As shown in FIG. 1, in accordance with various embodiments, when the combination bag/vest 100 is in the bag 100*a* configuration the vest 100*b* is concealed by the bag 100*a*. In accordance with some embodiments, this feature advantageously allows a wearer to inconspicuously maintain access to personal protection and/or tactical equipment.

The chest and back bag layers 101, 102 can be constructed of one or more layers of any suitable material, including for example but not limited to, nylon, cotton, polyester, polypropylene, wool, leather, Kevlar, canvas, any woven textile, any non-woven textile, any tricot, any knit textile, and/or any other suitable material. In general, to provide inconspicuous concealment of the vest 100*b*, the chest and back bag layers 101, 102 should be constructed from materials and designed to have an appearance consistent with the desired bag 100*a* configuration, e.g., a briefcase as shown in FIG. 1.

Figure 13:
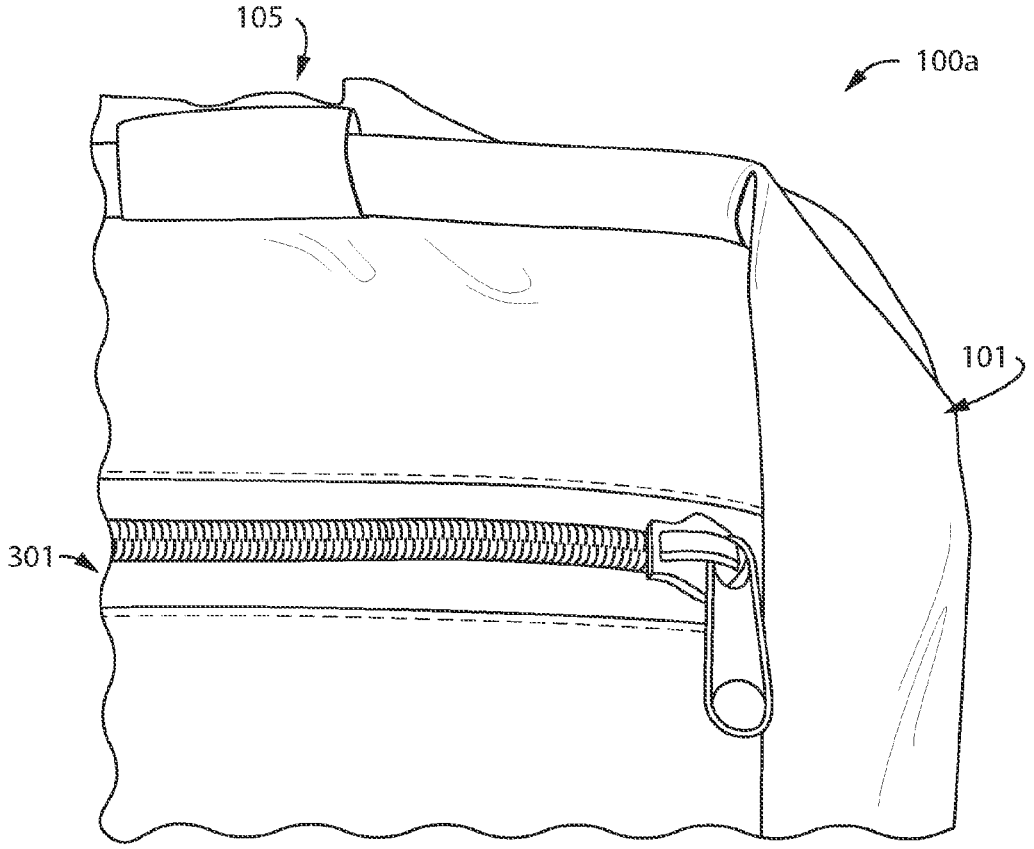
FIG. 13 is a close up view of a closeable bag pocket of a combination bag/vest in a bag configuration in accordance with various embodiments.

Although the bag 100*a* configuration as illustrated herein shows only a simple exemplary briefcase for clarity, it will be apparent in view of this disclosure that any number of bag 100*a* configurations can be used. For example, the bag 100*a* configuration can include chest and back bag layers 101, 102 that appear to be and/or function as a briefcase, a backpack, a duffel bag, a laptop case, a beach bag, a diaper bag, a satchel, a purse, and/or any other suitable bag or luggage. As shown in FIGS. 1 and 13, the bag 100*a* can include any number, size, shape, and style of bag pockets, e.g., zippable pocket 301 as shown in FIG. 13, storage compartments, and/or other additional features, e.g., handles 105 as shown in FIG. 1, buttons, snaps, flaps, embroidery, and/or patches.

These additional features can, in accordance with various embodiments, be included to allow the bag 100*a* and the chest and back layers 101, 102 to achieve appropriate function and/or appearance consistent with the bag 100*a* configuration of the particular combination bag/vest 100. In accordance with some embodiments, the chest bag layer 101 and/or the back bag layer 102 are fixedly attached (e.g., glued, sewn, stitched, and/or heat pressed) to the chest covering portion 107 and/or back covering portion 109 of the vest 100*b*.

In accordance with various embodiments, the chest bag layer and/or the back bag layer 102 are removably attached (e.g., zipped, snapped, fastened by hook and loop fastener, and/or pinned) to the chest covering portion 107 and/or back covering portion 109 of the vest 100*b*. Such removable chest and back bag layers 101, 102 can, in accordance with various embodiments, advantageously provide a means for altering the appearance of the bag 100*a* configuration as appropriate for various activities and/or missions. For example, a first set of chest and back bag layers 101, 102 could be configured to appear and function as a briefcase at the office. However, a briefcase is inappropriate for a day at the beach and would be conspicuous. Accordingly, rather than owning two combination bag/vests 100 (one appearing to be a briefcase and one appearing to be a beach bag), the wearer of a combination bag/vest 100 having removable chest and back bag layers 101, 102 could simply swap the first set of chest and back bag layers 101, 102 for a second set of chest and back bag layers 101, 102 configured to appear and function as a beach bag.

Accordingly, combination bag/vests which, in a bag configuration, serve as a functional bag and which, in a vest configuration, include a system for attaching one or more modular accessories to the vest in a desired configuration are provided herein. Also described herein are such combination bag/vests wherein the vest configuration operates as a tactical personal body armor vest and the bag configuration conceals the tactical vest portion while permitting the one or more modular accessories to remain in the desired configuration.

It is noted that the foregoing examples have been provided merely for the purpose of explanation and are in no way to be construed as limiting of the present invention. While the present invention has been described with reference to an exemplary embodiment, it is understood that the words, which have been used herein, are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A combination bag/vest comprising:

a vest comprising:

a chest covering portion and a back covering portion the chest covering portion and back covering portion each portion having a vest surface;

a pair of separable shoulder straps each connecting an upper portion of the chest covering portion with an upper portion of the back covering portion to form and defining a head opening;

a modular accessory attachment system disposed on a vest surface of the chest and/or back covering portions for attaching one or more modular accessories to the chest and/or back covering elements in a desired configuration; and a bag comprising:

at least one back bag layer attached to the back covering portion opposite the vest surface;

at least one chest bag layer attached to the chest covering portion opposite the vest surface;

a back fastener band extending from the at least one back bag layer and a chest fastener band extending from the at least one chest bag layer; and at least one fastener for fastening the back fastener band to the chest fastener band;

wherein, in a vest configuration, the vest surface of the chest covering portion the vest surface of the back covering portion faces away from a wearer of the vest;

wherein, in a bag configuration, the back fastener band and the chest fastener band are at least partially fastened such that the back bag layer and the chest bag layer are exposed and the vest surfaces of the chest covering portion and back covering portion are concealed;

wherein the desired configuration of the one or more modular accessories attached to the modular accessory attachment system on the vest surface of the chest and/or back covering portions is maintained in both the vest configuration and the bag configuration; and wherein, in a bag configuration, the desired configuration of the one or more modular accessories attached to the modular accessory attachment system on the vest surface of the chest and/or back covering portions is concealed from view.

2. The combination bag/vest of claim 1, wherein the at least one fastener is a zipper.

3. The combination bag/vest of claim 1, wherein the vest further comprises at least one securing device for securing the vest to the wearer by securing a lower end of the back covering portion to a lower end of the chest covering portion.

4. The combination bag/vest of claim 1, wherein, in the bag configuration, the combination bag/vest is configured to appear to be one or more of a briefcase, a backpack, a duffel bag, a laptop case, a beach bag, a diaper bag, a satchel, and/or a purse.

5. The combination bag/vest of claim 4, wherein, in the bag configuration, the bag functions as the one or more of a briefcase, a backpack, a duffel bag, a laptop case, a beach bag, a diaper bag, a satchel, and/or a purse, the concealment portion including one or more compartments and/or pockets.

6. The combination bag/vest of claim 1, wherein the vest further comprises one or more PALS webbing elements disposed on a surface of the shoulder straps for routing at least one tube and/or wire between the chest covering portion and the back covering portion.

7. The combination bag/vest of claim 1, further comprising at least one closeable chest pouch defined in the chest covering portion between an outer chest textile layer and an interior chest textile layer for receiving one or more inserts and/or at least one closeable back pouch defined in the back covering portion between an outer back textile layer and an interior back textile layer for receiving one or more inserts.

8. The combination bag/vest of claim 7, wherein the at least one closeable back pouch and/or the at least one closeable chest pouch are configured to receive one or more armor plates.

9. The combination bag/vest of claim 7, wherein the at least one closeable back pouch and/or the at least one closeable chest pouch are configured to receive one or more floatation elements.

10. The combination bag/vest of claim 7, wherein the at least one closeable back pouch and/or the at least one closeable chest pouch are configured to receive one or more insulation elements.

11. The combination bag/vest of claim 1, wherein the chest covering portion and/or the back covering portion includes an insulating layer and at least one reflective element disposed on the vest surface.

12. The combination bag/vest of claim 1, wherein the modular accessory attachment system includes a plurality of Pouch Attachment Ladder System (PALS) webbing elements attaching one or more Modular Lightweight Load-carrying Equipment (MOLLE)-compatible accessories to the chest and/or back covering elements in a desired configuration.

* * * * *